US007712175B2

(12) United States Patent
Blanchard et al.

(10) Patent No.: US 7,712,175 B2
(45) Date of Patent: May 11, 2010

(54) TOOTHBRUSH WITH POLISHING MEMBER

(75) Inventors: Stephen John Blanchard, Princeton, NJ (US); Bethann O'Malley, Hillsborough, NJ (US); Justin McDonough, Flemington, NJ (US)

(73) Assignee: McNeil-PPC, Inc., Skillman, NJ (US)

( * ) Notice: Subject to any disclaimer, the term of this patent is extended or adjusted under 35 U.S.C. 154(b) by 599 days.

(21) Appl. No.: 11/463,363

(22) Filed: Aug. 9, 2006

(65) Prior Publication Data

US 2007/0199168 A1 Aug. 30, 2007

Related U.S. Application Data

(60) Provisional application No. 60/710,399, filed on Aug. 23, 2005.

(51) Int. Cl.
*A46B 9/04* (2006.01)

(52) U.S. Cl. ..... 15/106; 15/110; 15/167.1; 15/188; 601/141; 606/161

(58) Field of Classification Search ..... 15/106, 15/110, 111, 117, 167.1, 188; 601/139, 141; 606/161
See application file for complete search history.

(56) References Cited

U.S. PATENT DOCUMENTS

| | | | | | |
|---|---|---|---|---|---|
| 245,585 | A | | 8/1881 | Tracy | |
| 403,350 | A | | 5/1889 | Horsey | |
| 1,125,532 | A | * | 1/1915 | Himmel | 15/117 |
| 1,128,139 | A | | 2/1915 | Hoffman | |
| 1,209,516 | A | | 12/1916 | Thompson | |
| 1,405,279 | A | | 1/1922 | Cassedy | |
| 1,517,615 | A | | 12/1924 | Chynoweth | |
| 1,817,585 | A | * | 8/1931 | Samuel | 15/188 |
| 1,892,068 | A | * | 12/1932 | Metzler | 601/139 |
| 2,039,278 | A | * | 5/1936 | Blanchard | 15/188 |
| 2,206,726 | A | * | 7/1940 | Lasater | 15/188 |
| 2,244,699 | A | * | 6/1941 | Hosey | 15/188 |
| 2,279,355 | A | * | 4/1942 | Wilensky | 15/110 |
| 2,364,205 | A | | 12/1944 | Fuller | |
| 2,545,814 | A | * | 3/1951 | Kempster | 15/188 |
| 2,987,742 | A | | 1/1961 | Kettle et al. | |
| 3,007,441 | A | * | 11/1961 | Eyer | 433/1 |
| 3,258,805 | A | | 7/1966 | Rossnan | |
| 3,337,893 | A | | 8/1967 | Fine et al | |
| 3,985,147 | A | | 10/1976 | Ricketts et al. | |
| 4,381,792 | A | | 5/1983 | Busch, Jr. et al. | |
| 4,576,190 | A | | 3/1986 | Yousef | |
| 4,875,247 | A | | 10/1989 | Berg | |
| 5,040,260 | A | | 8/1991 | Michaels | |

(Continued)

FOREIGN PATENT DOCUMENTS

| | | |
|---|---|---|
| EP | 0148726 A2 | 11/1984 |

(Continued)

*Primary Examiner*—Mark Spisich
(74) *Attorney, Agent, or Firm*—Karen G. Horowitz

(57) ABSTRACT

The invention is directed to toothbrushes that include a handle, a neck a head, and a polishing member attached to the head, where the polishing member includes a base proximate the backside of the head and a plurality of projections of sufficient size and shape and disposed in a pattern on the base that are effective to provide polishing of teeth.

19 Claims, 5 Drawing Sheets

U.S. PATENT DOCUMENTS

| | | | |
|---|---|---|---|
| 5,249,961 | A | 10/1993 | Hoaglang |
| 5,273,425 | A | 12/1993 | Hoaglang |
| 5,273,559 | A | 12/1993 | Hammar et al. |
| 5,604,951 | A | 2/1997 | Shipp |
| 5,771,522 | A | 6/1998 | Carmody |
| 5,799,355 | A | 9/1998 | Burch et al. |
| 5,930,860 | A | 8/1999 | Shipp |
| 6,067,684 | A | 5/2000 | Kweon |
| 6,254,468 | B1 | 7/2001 | Gozzie et al. |
| 6,463,619 | B2 | 10/2002 | Gavmey, Jr. |
| 2001/0016308 | A1 | 8/2001 | Bechmann et al. |
| 2002/0127513 | A1 | 9/2002 | Bechmann et al. |
| 2003/0026769 | A1 | 2/2003 | Horwood |
| 2004/0074031 | A1 | 4/2004 | Davies et al. |
| 2004/0134007 | A1 | 7/2004 | Davies |
| 2005/0000049 | A1 | 1/2005 | Hohliebein |
| 2005/0069373 | A1 | 3/2005 | Parikh et al. |
| 2005/0166344 | A1 | 8/2005 | Hohliebein |

FOREIGN PATENT DOCUMENTS

| | | | |
|---|---|---|---|
| WO | WO 98/18364 | A1 | 5/1998 |
| WO | WO 99/60886 | A1 | 12/1999 |
| WO | WO 00/53054 | A1 | 9/2000 |
| WO | WO 2004/112538 | A1 | 12/2004 |

* cited by examiner

TOOTHBRUSH WITH POLISHING MEMBER

This application claims the benefit under 35 U.S.C. 119 (e) of U.S. Provisional Application Ser. No. 60/710,399, filed on Aug. 23, 2005.

FIELD OF THE INVENTION

The invention relates to toothbrushes having a head that includes a polishing member suitable for removing extrinsic stains from teeth.

BACKGROUND OF THE INVENTION

Toothbrushes that contain both bristles for brushing teeth and elements for polishing teeth are known. However, designs and configurations of polishing elements used in conventional toothbrushes may not provide sufficient polishing. Therefore, it would be advantageous to provide a toothbrush that not only provides effective brushing and cleaning of teeth, but that also provides enhanced polishing, i.e. removal of extrinsic stains, of teeth. The toothbrushes of the present invention utilize a novel polishing member that provides such enhanced removal of extrinsic stains from teeth.

SUMMARY OF THE INVENTION

The invention is directed to toothbrushes including a handle, a neck and a head, where the head includes a front side that contains a plurality of bristles attached thereto for cleaning teeth, and a back side opposite the front side. The toothbrush also includes a polishing member attached to the head. The polishing member includes a base proximate the backside of the toothbrush head and a plurality of projections having a proximal end terminating at the base and a distal end extending upwards from the base. The projections are of sufficient size and shape and are disposed in a pattern on the base that is effective to remove extrinsic stains from teeth.

DETAILED DESCRIPTION OF THE INVENTION

Figure 1:
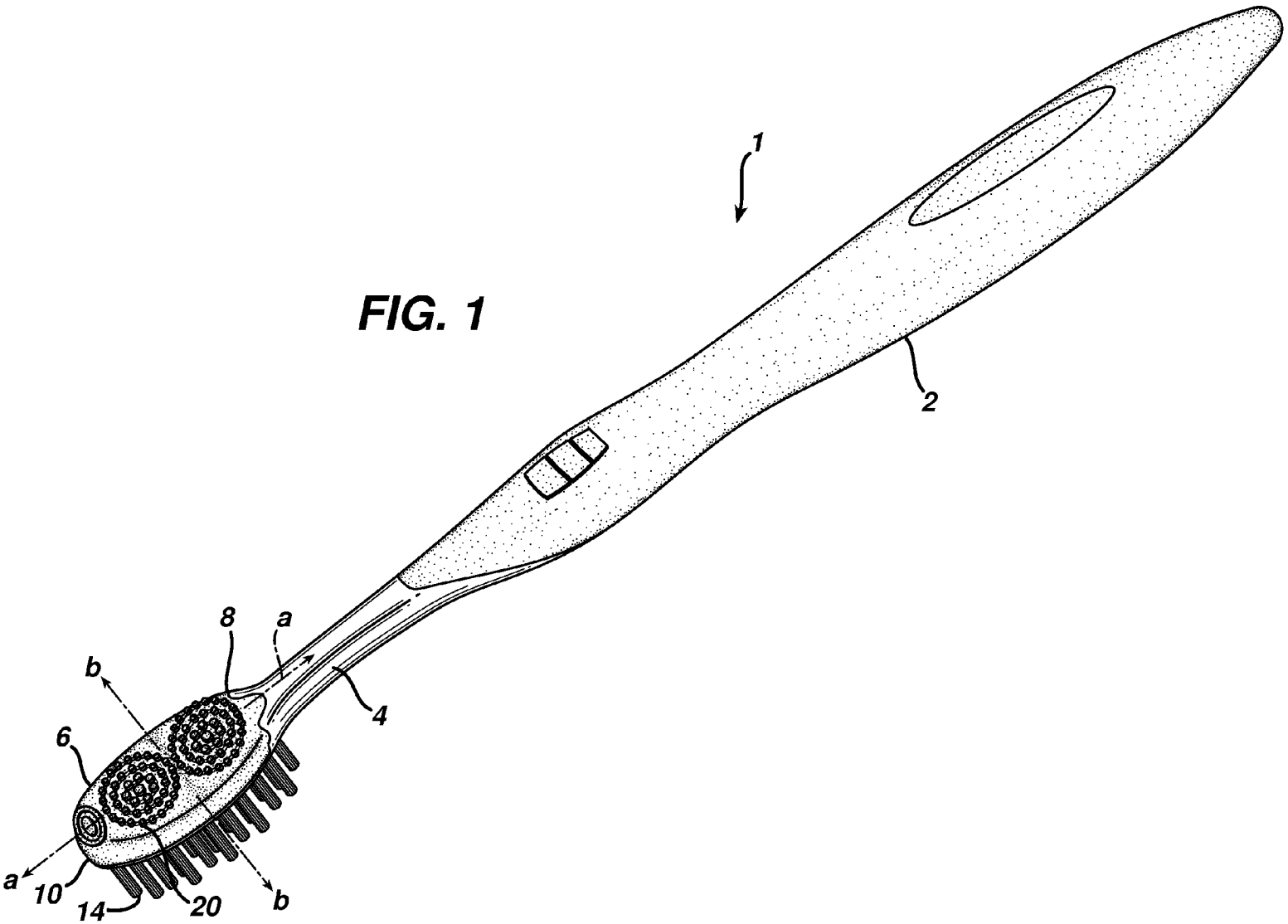
FIG. 1 is a perspective view of one toothbrush of the invention as seen from the bottom.
Figure 2:
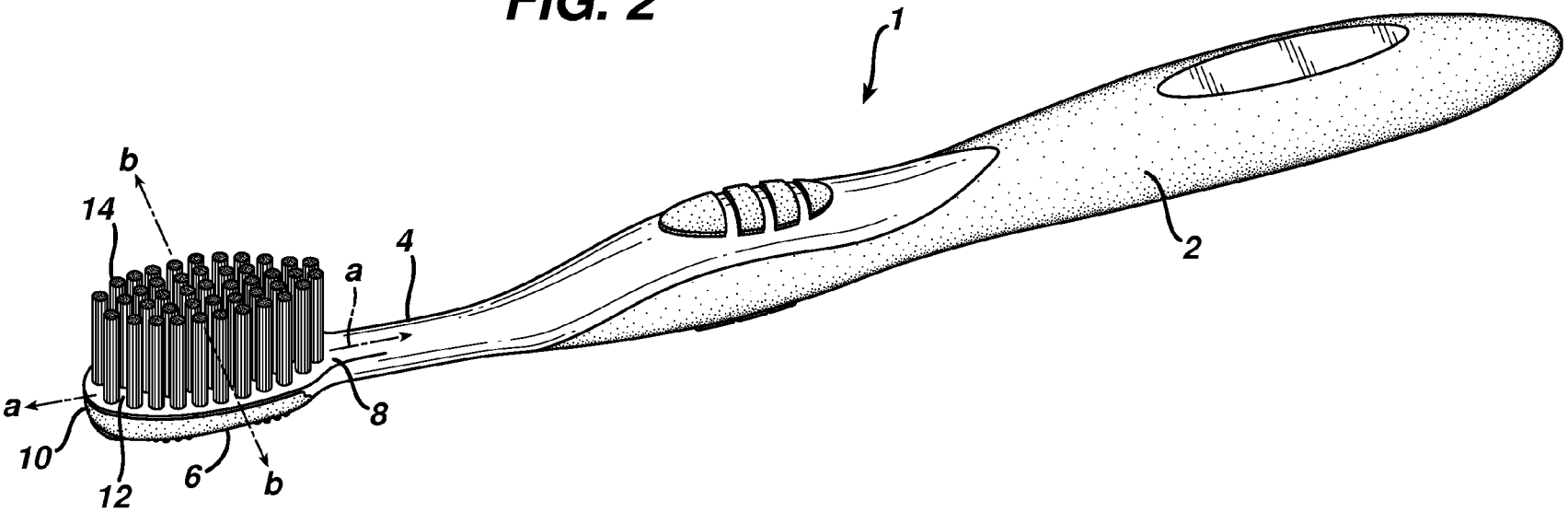
FIG. 2 is a perspective view of the toothbrush of FIG. 1 as seen from the top.
Figure 3:
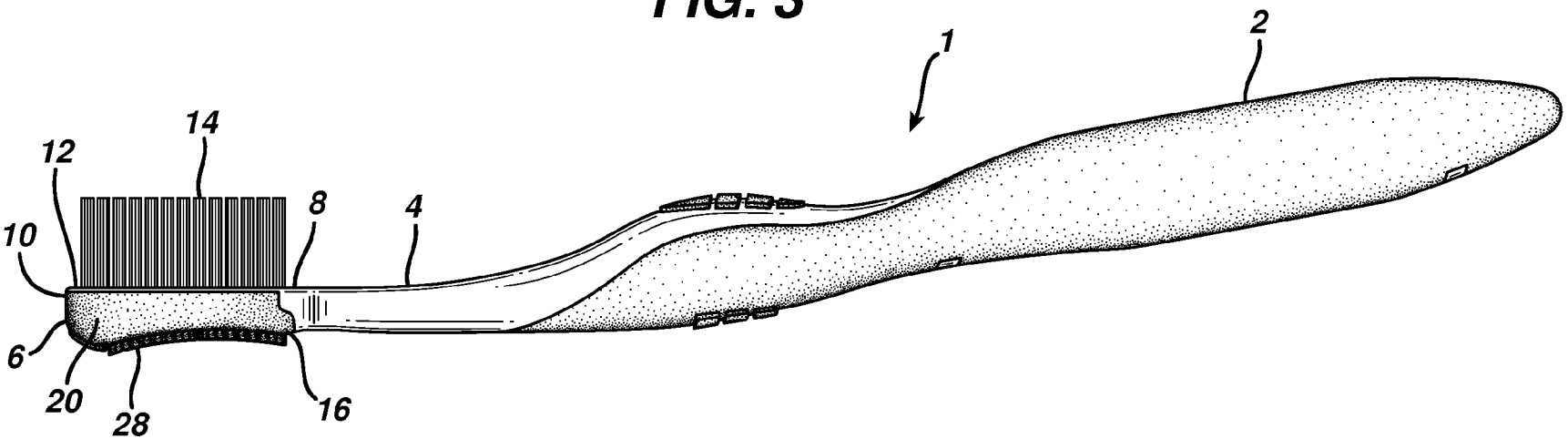
FIG. 3 is a side elevational view thereof.

The present invention is directed to a toothbrush that includes a handle, a neck area and a head. The neck area of the toothbrush is integral with and interconnects the handle and head of the toothbrush. The head includes a proximal end proximate the neck area and a distal end terminating at the distal end of the toothbrush. The head comprises a longitudinal axis and a horizontal axis transverse the longitudinal axis. The head includes a front side containing bristles suitable for cleaning and brushing teeth. Any conventional configuration or design of bristles suitable for cleaning and brushing teeth may be employed in toothbrushes of the present invention. There are numerous options for the type of bristles used in addition to or instead of standard nylon bristles. These options include bristles with abrasives, active ingredients, whitening agents or antibacterial agents. In certain embodiments the bristles may be of varying length and pattern.

The head also contains a backside opposite the front side. The backside may be, but is not necessarily, concave so as to approximate the curvature of teeth in the mouth. The periphery of the head may be in the shape of a parallelogram, for example a rectangle, or an ellipse, for example an oval, provided that it is suitable for use within the mouth.

The toothbrush also includes a polishing member located at the head of the toothbrush. As used herein, "polishing" is meant to denote the efficacious removal of extrinsic stains from teeth. The polishing member includes a proximal end proximate the neck area and a distal end terminating at the distal end of the head. The polishing member comprises a longitudinal axis and a horizontal axis transverse the longitudinal axis. The periphery of the polishing member substantially conforms to the shape of the head and may be in the shape of a parallelogram, for example a rectangle, or an ellipse, for example an oval, provided that it is suitable for use within the mouth. As with the head, the polishing member may be, but is not necessarily, concave to conform to the natural curvature of teeth in the mouth. In certain embodiments both the head and polishing member may be concave, or the polishing member alone may be concave to conform to the curvature of the teeth.

The polishing member comprises a base proximate the backside of the toothbrush head and a plurality of projections extending upwardly from the base. Preferably, but not necessarily, the projections extend upwards and are substantially perpendicular to the base of the polishing member. The projections comprise a proximal end proximate the base of the polishing member and a distal end for contacting teeth. The shape of the projections may be selected from the group consisting of cylindrical, conical, rectangular, square, oblong, elliptical, oval, star, triangle, and polygonal. Additionally the projections could be cup-shaped to mimic the prophy cup a dentist uses.

The projections in the polishing member can be tapered so that the cross-sectional area of the distal end of the projection is less than cross-sectional area of the proximal end of the projections. In addition, the cross-sectional area of projections in an outer portion of the polishing member or a particular pattern on the polishing member may be less than or greater than the cross-sectional area of projections in an inner portion of the polishing member or particular pattern on the polishing member, whereby the polishing member and/or polishing pattern comprises a gradient of cross-sectional surface area.

The flexibility/stiffness of the projections is a function of the geometry and the material properties making up the polishing elements. The geometry or shape of the projections, for example length, width and/or circumference, are selected so as to provide optimum polishing of the teeth, while also providing optimum gentleness to the gums. For example, the projections should be rigid enough to provide strength for polishing, while also being flexible enough to prevent damage to gums upon contact therewith while polishing the teeth. In certain embodiments the projections could be hollow, such as a cylinder, where the wall thickness geometry and size could be adjusted to provide similar flexibility, while providing moe edges per area, which may enhance polishing efficacy. In other embodiments softer materials, such as thermoplastic elastomers (TPE), may be used on the outer portions of the polishing member to contact with gums, and harder materials (TPE) may be used on the inner portion of the polishing member for efficacious polishing of teeth.

A plurality of projections is disposed in a pattern on the polishing member base that is effective to enhance polishing of the surface of teeth. The surface formed by the distal ends of the projections in the pattern may be concave so as to conform to the natural curve of teeth, although it is not required. The periphery of the pattern may be in the shape of a parallelogram such as a rectangle or square, an ellipse such as an oval, or a circle. The pattern also may be in the form of a spiral comprising a plurality of projections. The pattern comprises a longitudinal axis substantially parallel to the longitudinal axis of the toothbrush head and a horizontal axis transverse the longitudinal axis of the pattern and substantially parallel to the horizontal axis of the toothbrush head. The two axes bisect their respective planes and may, but need not, intersect at the center of the pattern. The pattern may comprise repeating configurations of projections emanating at the periphery of the pattern and continuing towards the center of the pattern at spaced-apart intervals. For example, the pattern may comprise a plurality of elliptical or circular rings, or a plurality of parallelograms, each comprising a plurality of projections. The space between the individual rings or parallelograms and the distance between the individual projections comprising the rings or parallelograms may be selected to provide optimum polishing, and/or to aid in retention of additional cleaning or polishing materials that may be utilized with the polishing member to enhance polishing, as described herein below.

The patterns may also include additional structural elements, for example walls, which rise substantially vertically from the polishing member base. The walls may interconnect the individual projections within an individual configuration of projections within the pattern. Alternately, the structural elements may be located between, within and/or around the projections. The width of the structural elements may be less than the diameter or cross-sectional area of the polishing projections. The height can be greater than or equal to individual projections to provide wiping and holding function, whereby the additional structural elements serve to retain additional cleansing or polishing materials within the polishing pattern to enhance polishing of the teeth, or less than individual projections to provide holding function only. In certain embodiments the wall thickness may be about 0.25 mm and the wall height about 0.3 mm from base.

The polishing member may comprise a single pattern of projections covering a portion or substantially all of the base of the polishing member, so as to provide an effective polishing area. The polishing member may comprise a plurality of patterns, for example two or more patterns, positioned along the longitudinal axis of the polishing member. Multiple polishing patterns provide improved conformance to the irregular surfaces of the teeth, as the separate patterns can move independently of each other. The patterns may be positioned equidistant from the horizontal axis bisecting the polishing member, or may be positioned at irregular spaced-apart intervals along the longitudinal axis. The plurality of patterns may be of the same or different peripheral shape. For example, a combination of a parallelogram pattern and a circular, or elliptical pattern may be employed in the polishing member.

Referring to FIGS. 1-5, where like numbers refer to like elements, a toothbrush of the present invention is shown. Toothbrush 1 includes handle 2, neck 4, and head 6. Head 6 includes proximal end 8 proximate neck 4, distal end 10 terminating at the distal end of toothbrush 1, backside 16, front side 12 opposite backside 16 and bristles 14 extending from front side 12. Longitudinal axis a substantially bisects head 6 and horizontal axis b is substantially transverse to longitudinal axis a. Toothbrush 1 further includes polishing member 20 located about and attached to head 6.

Polishing member 20 includes proximal end 22 proximate neck 4 and distal end 24 terminating at distal end 10 of head 6. Polishing member 20 has longitudinal axis c substantially parallel to longitudinal axis a of head 6, and horizontal axis d transverse longitudinal axis c and substantially parallel to longitudinal axis b of head 6. A plurality of projections 28 extends upwards from base 26 of polishing member 20 to form a pattern to facilitate polishing of teeth.

Figure 4:
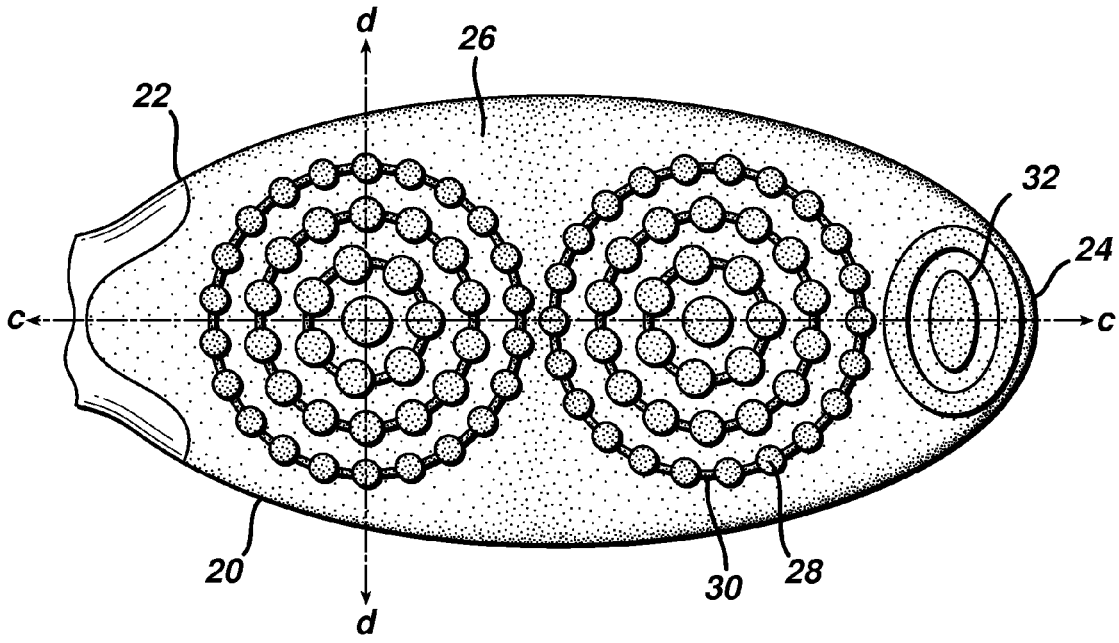
FIG. 4 is an enlarged fragmentary bottom view of the toothbrush of FIG. 1.
Figure 5:
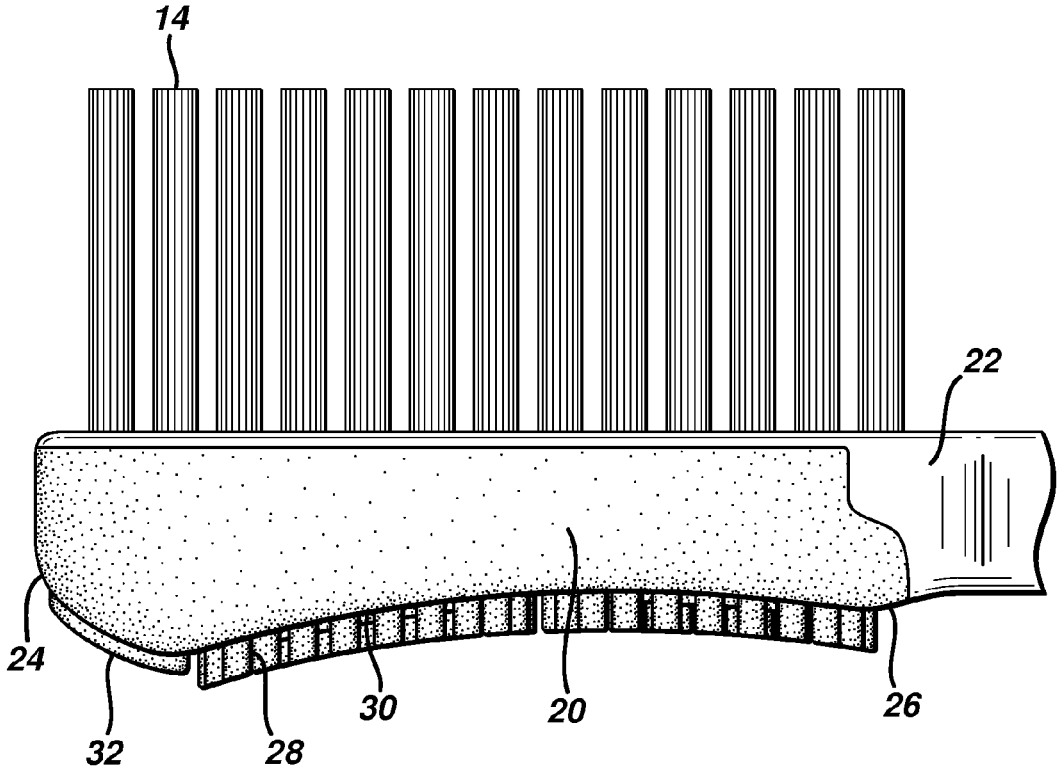
FIG. 5 is an enlarged fragmentary side view of the toothbrush of FIG. 1.

In certain embodiments as shown in the FIGS. 4 and 5, polishing member 20 comprises two patterns, each comprising a plurality of concentric circles and a single cylindrical projection at the center of the pattern, each concentric circle comprising a plurality of cylindrical projections 28. Each pattern is disposed along longitudinal axis c of the polishing member. The cylindrical projections may be of consistent diameter, or different diameter. In one embodiment, the diameter of the cylindrical projections in the outer ring may be less than the diameter of projections in the inner ring and/or the projection in the center of the pattern. In other embodiments, a diameter gradient may exist, whereby the diameter of the projections in the respective concentric circles progressively increases from the outer ring to the inner rings, to the center of the pattern. As shown, each of the cylindrical projections may be about 1.13 millimeter (mm) high. The diameters of the cylindrical projections in the respective rings progressing from the outer ring to the center of the pattern may be about 0.90 mm (outer ring), about 1.07 mm (middle ring), about 1.14 mm (inner ring), and about 1.52 mm (center projection), respectively. The diameter, geometry, number, density, and height of the projections may be changed in order to achieve a different amount of flex upon use if desired.

Although cylindrical projections are exemplified, projections having different shapes could be used in the same pattern. Where non-circular, non-cylindrical projections are employed, the cross-sectional area of the projection at a given distance extending from the proximal end of the projection towards the distal end of the projection may vary. For example, the cross-sectional area of projections in the outer ring may be less than the cross-sectional area of projections in inner rings or at the center of the pattern, and a gradient of cross-sectional area may also exist, as with the diameter gradient. As the diameter or cross-sectional area of the individual projections decreases, the flexibility increases. When the product is in use, the projections in contact with the users gum line will be those with the smaller diameter or cross-sectional area, which are most flexible.

As shown, structural element, e.g. wall, 30 connects cylindrical projections 28 in each ring. The wall, combined with the close spacing between the polishing projections, helps to hold toothpaste or other polishing materials against the teeth while polishing the teeth. This enhances the efficacy of the polishing member due to the abrasive in the toothpaste. Also, it provides lubricating properties to enhance the polishing experience. The wall forms an annular element connecting adjacent elements located at a common diameter from the central point of the polishing pattern.

In other embodiments of the invention, the distal end of the polishing member may angled relative to the longitudinal axis of the polishing member to provide an additional scrubbing portion 32. As shown in FIGS. 4 and 5, the scrubbing portion may be on a convex radius of about 3 mm, defined by an angle of about 25 degrees relative to the longitudinal axis of the polishing member, over a linear length, i.e. linear distance between radius end points defined by the 25 degree angle, of about 5 mm. The scrubbing portion may include a ridged elliptical pattern as shown, disposed on the face thereof. This scrubbing portion design allows the user to turn the brush vertically and focus the stain removal on specific areas. The elliptical ridges can hold toothpaste or other polishing materials in place to enhance the polishing efficacy. As shown, the ridges on the scrubbing portion of the polishing member may be about 0.5 mm high. While the ridged elliptical pattern is shown, the ridges on the scrubbing portion could be eliminated, leaving a smooth polishing surface, or the scrubbing portion may be textured to provide different levels of drag and toothpaste/polishing material retention.

As shown in the figures, the toothbrush features slightly curved horizontal rows of bristles. The rows are trimmed in a stepped pattern to allow better interdental penetration, as opposed to a flat trim. There are numerous ways the tufts can be arranged and trimmed to optimize plaque and stain removal.

The toothbrushes of the present invention are made via various injection molding processes known and used by those skilled in the art. The core of the brush, which includes the handle, neck and head, may be polypropylene or another suitable thermoplastic. A thermoplastic elastomer (TPE) or another suitable material may be molded in a separate molding step over part of the handle to enhance the grip of the brush. Such processes also are known to those skilled in the art. The polishing member is injection molded in a separate injection step over the backside of the and around the edges of the head of the polypropylene core. The polishing member is thusly attached to the head as a separate, yet substantially fixedly attached member. The polishing member may be comprised of the same TPE used to fabricate the brush handle, or it may be constructed of an alternative TPE, silicone rubber, polyurethane, or other resilient material. The polishing member may or may not contain additives for enhanced cleaning efficacy or visual appearance.

Abrasives can be added to the polishing member and projections to increase the stain removal efficacy of the polishing member if so desired. These abrasives can include silica, mica, hydroxyapatite, fibers, or calcium carbonate. Additives such as alumina can also be added to enhance the aesthetics of any of the brush components. Other options for additives include agents to modify coefficient of friction, flavor, scent, whitening agents, pigments, chemotherapeutic agents and antibacterial agents.

EXAMPLE 1

Two independent studies using the same methodology were conducted to evaluate the efficacy of the toothbrush of the present invention depicted in FIGS. 1-5. Each study consisted of a 2-week pre-trial period of standardized stain development followed by 5 weeks of product usage. The subjects were examined for extrinsic tooth stain and oral health after 2, 4 and 5 weeks of product usage. 73 subjects were included in the first study, and 69 subjects were included in the second.

Pre-Trial Period

All subjects received a dental prophylaxis before the staining period. A "forced stain model" was then used to rapidly induce stain on the anterior teeth by means of limited toothbrushing and stain forming rinses (See: Addy M, Moran J, Newcombe R, Warren P: *The comparative tea staining potential of phenolic, chlorhexidine and anti-adhesive mouthrinses; J Clin Periodontol* 22:923-928, 1995). Subjects were instructed to brush twice daily with a low-abrasive fluoride dentifrice and soft toothbrush. In the morning and after brushing at bedtime, subjects rinsed with both commercial 0.12% chlorhexidine rinse and double strength tea. After lunch, subjects rinsed with tea only.

Trial Period

The subjects received both verbal and written instruction for the test period. They were advised to brush twice each day, once in the morning and once at night, with the assigned dentifrice and toothbrush for the entire 5-week trial period. Subjects were instructed to, after brushing, polish their anterior teeth with the polishing pad on the back of the brush head for 60 seconds using a circular motion. This step was done with the toothpaste slurry already in the subjects' mouth from brushing. The instructor supervised initiation of the first treatment to ensure that the subjects found use of the test products acceptable.

In both studies, the toothbrush of the present invention significantly lowered extrinsic stain at each visit compared to baseline, as evaluated with the Modified Lobene Stain Index (MLSI). The MLSI data is summarized as follows.

Clinical Study 1:

MLSI scores at each visit.

Baseline: 4.04; Week 2: 2.93; Week 4: 2.53; Week 5: 2.42

MLSI change from Baseline Means Comparison to Zero

Week 2: Mean 1.10; Standard Deviation 0.98; p value 0.0001

Week 4: Mean 1.51; Standard Deviation 1.0; p value 0.0001

Week 5: Mean 1.61; Standard Deviation 1.07; p value 0.0001

Clinical Study 2:

MLSI scores at each visit.

Baseline: 1.69; Week 2: 0.89; Week 4: 0.74; Week 5: 0.67

MLSI change from Baseline Means Comparison to Zero

Week 2: Mean 0.81; Standard Deviation 0.65; p value less than 0.0001

Week 4: Mean 0.95; Standard Deviation 0.70; p value less than 0.0001

Week 5: Mean 1.01 Standard Deviation 0.72; p value less than 0.0001

EXAMPLE 2

In Vitro Testing

The toothbrush as depicted in FIGS. 1-5 was evaluated using an industry-accepted method of determining stain removal in the laboratory. The sample size for this evaluation was 16 brushes. The test was based on the method described by Stookey, et al (Stookey, G. K.; Burkhard, T. A.; and Schemehorn, B. R.: *In vitro removal of stain with dentifrices; J Dent Res* 61(11):1236-1239, November 1982), which involves testing the toothbrush on stained bovine teeth. The whiteness of the teeth before and after treatment is determined by using a spectrophotometer to measure the L*a*b values of the specimen. The polishing member on the toothbrush as depicted was statistically effective in removing extrinsic stain from teeth when evaluated in vitro using a standard dentifrice slurry.

We claim:

1. A toothbrush, comprising:

a handle, a neck, a head, said head comprising a front side comprising a plurality of bristles and a backside opposite said front side; and a polishing member attached to said head, said polishing member comprising a base proximate said backside of said head, and a plurality of projections extending upwards from said base, said projections having a size and a shape and being disposed in a pattern on said base of said polishing member that is effective to provide polishing of teeth, wherein said pattern comprises a plurality of concentric rings disposed about a center of said pattern, each of said concentric rings comprising said plurality of projections.

2. The toothbrush of claim 1 wherein said shape of said projection is cylindrical.

3. The toothbrush of claim 2 wherein the diameter of said cylindrical projections in an outer ring of said pattern is less than the diameter of said cylindrical projections in an inner ring of said pattern.

4. The toothbrush of claim 2 wherein said toothbrush comprises a plurality of said patterns disposed along a longitudinal axis of said polishing member.

5. The toothbrush of claim 4 wherein said polishing member further comprises a wall interconnecting each of said plurality of projections in said concentric rings.

6. The toothbrush of claim 5 wherein said polishing member further comprises a scrubbing portion proximate a distal end of said polishing member.

7. The toothbrush of claim 6 wherein said wall has a thickness of about 0.25 millimeters and a height from said base of said polishing member of about 0.3 millimeters.

8. The toothbrush of claim 7 wherein each of said projections extends upwards about 1 millimeter from said base of said polishing member, the diameter of projections in an outer concentric ring in said pattern is about 0.9 millimeters, the diameter of projections in a middle ring in said pattern is about 1.07 millimeters, and the diameter of projections in an inner ring in said pattern is about 1.14 millimeters.

9. The toothbrush of claim 6 wherein said backside of said head and said base of said polishing member are concave.

10. The toothbrush of claim 1 wherein a cross-sectional area of said projections comprises a gradient.

11. The tooth brush of claim 10 wherein said cross-sectional area of said projections in an outer portion of said polishing member are less than said cross-sectional area of said projections in an inner portion of said polishing member.

12. The tooth brush of claim 10 wherein said cross-sectional area of said projections in an outer portion of said polishing member are greater than said cross-sectional area of said projections in an inner portion of said polishing member.

13. The tooth brush of claim 10 wherein said cross-sectional area of said projections in an outer portion of said pattern are less than said cross-sectional area of said projections in an inner portion of said pattern.

14. The tooth brush of claim 10 wherein said cross-sectional area of said projections in an outer portion of said pattern are greater than said cross-sectional area of said projections in an inner portion of said pattern.

15. The toothbrush of claim 1 wherein said polishing member comprises a plurality of said patterns disposed along a longitudinal axis of said polishing member.

16. The toothbrush of claim 1 wherein said polishing member further comprises a wall interconnecting each of said plurality of projections in said concentric rings.

17. The toothbrush of claim 1 wherein the shape of said projections is selected from the group consisting of cylindrical, conical, rectangular, square, oblong, elliptical, oval, star, triangle and polygonal.

18. The toothbrush of claim 1 wherein said polishing member further comprises a scrubbing portion proximate a distal end of said polishing member.

19. The toothbrush of claim 1 wherein a cross-sectional area of a distal end of said projection is less than a cross-sectional area of a proximal end of said projections.

* * * * *